United States Patent [19]

Freerks

[11] 4,455,788

[45] Jun. 26, 1984

[54] ABRASIVE WHEEL AND DRIVE SPINDLE COMBINATION WITH IMPROVED ATTACHING MEANS

[75] Inventor: Conrad T. Freerks, Maplewood

[73] Assignee: Minnesota Mining and Manufacturing Company, St. Paul, Minn.

[21] Appl. No.: 545,581

[22] Filed: Oct. 25, 1981

Related U.S. Application Data

[63] Continuation of Ser. No. 274,668, Jun. 17, 1981, abandoned.

[51] Int. Cl.[3] ..... B24D 13/04

[52] U.S. Cl. ..... 51/334; 51/168

[58] Field of Search ..... 51/168, 334–337

[56] References Cited

U.S. PATENT DOCUMENTS

| | | | |
|---|---|---|---|
| 1,382,606 | 6/1921 | Norton | 51/168 |
| 2,562,327 | 7/1951 | Moore | 51/168 |
| 2,651.894 | 9/1953 | Leggett | 51/334 |
| 3,369,763 | 2/1968 | Perry | 51/168 |
| 3,561,173 | 2/1971 | Block | 51/334 |
| 3,667,170 | 6/1972 | MacKay | 51/889 |
| 4,229,912 | 10/1980 | Laughlin | 51/336 |

FOREIGN PATENT DOCUMENTS

| | | | |
|---|---|---|---|
| 438854 | 11/1935 | United Kingdom | 51/168 |

*Primary Examiner*—Harold D. Whitehead

*Attorney, Agent, or Firm*—Donald M. Sell; James A. Smith; William L. Huebsch

[57] ABSTRACT

An abrasive wheel and drive spindle combination. The spindle is releasably engaged with the abrasive wheel by inserting a threaded end portion of the spindle through an opening in an inner flange of the abrasive wheel and rotating the spindle in a first direction to engaging it with a thread around a central opening in an outer flange of the abrasive wheel. Upon such engagement a collar on the spindle enters and is pressed into a socket coaxially centered in the inner flange to coaxially and releasably lock the abrasive wheel to the spindle so that further rotation of the spindle in the first direction rotates the wheel, and the flanges are held together during use of the wheel.

4 Claims, 2 Drawing Figures

ABRASIVE WHEEL AND DRIVE SPINDLE COMBINATION WITH IMPROVED ATTACHING MEANS

This is a continuation of application Ser. No. 274,668 filed June 17, 1981, now abandoned.

TECHNICAL FIELD

This invention relates to mechanisms for releasably attaching abrasive wheels to drive spindles.

BACKGROUND ART

Well known are abrasive wheel and spindle combinations of the type comprising a hub having axially-spaced inner and outer side flanges, abrasive material such as a multiplicity of abrasive-coated flexible strips, randomly woven abrasive coated material, or other abrasive material fastened between and projecting radially outwardly from between the side flanges, and a drive spindle coaxially and releasably attached to the abrasive wheel. The drive spindle can be coupled to a drive motor via a chuck, and the drive motor activated to rotate the spindle and abrasive wheel about their axes while the projecting abrasive material is pressed into engagement with a surface to abrade the surface.

There are many occasions on which it is necessary or desirable to change the abrasive wheel attached to the drive spindle such as when the abrasive in the wheel becomes worn or when it is desired to use a different grade of abrasive. Heretofore, however, the known means for releasably attaching the abrasive wheel to the spindle have not been as strong for their diameter, inexpensive, or as convenient to use as might be desired. One such means has included a machine screw or bolt having a head against the outer surface of the outer flange and extending through the hub and the inner flange so that a projecting threaded end portion of the bolt can releasably engage a threaded socket in an end of the drive spindle. Upon such engagement the end of the spindle seats in a socket along the outer surface of the inner flange, rotation of the drive spindle in the direction in which the spindle would further engage the threaded end portion will rotate the abrasive wheel with the spindle, and engagement of the bolt head and end of the spindle against the outer surfaces of the flanges will hold the flanges firmly together during use of the wheel. In some such attaching means the bolt is not fixed to the hub and detachment of the flap wheel requires the workman to release the bolt with a tool, such as a screwdriver, which tool may not always be readily available. In other such attachment means the bolt is fastened within the hub either by cementing it in place or by threadably engaging it with the inner flange. Such attachment prevents separation of the bolt from the hub and allows the abrasive wheel to be attached to the drive spindle without the use of tools by grabbing the abrasive wheel about its periphery and rotating it and the bolt with respect to the spindle, which spindle can typically be held by holding the chuck in which the spindle is engaged. This approach, however, requires that a bolt be supplied with each abrasive wheel, which, together with the necessity of positioning the bolt within the hub, significantly increases the cost of the abrasive wheel. Whether or not the bolt is attached within the hub, several threads on the projecting end portion of the bolt must be engaged with a corresponding number of threads in the spindle to ensure proper alignment of the abrasive wheel with the spindle, and engagement of these threads becomes so firm during use of the wheel that typically the chuck in which the spindle is engaged must be held with a tool before the abrasive wheel can be detached. Also, the thread on the bolt adjacent the inner flange both weakens and provides a stress concentration point in the bolt compared to an unthreaded shaft of the same diameter, which is undesirable in view of the stresses applied to the bolt at this point both by transverse forces applied to the abrasive wheel through the bolt and the high rotational speed at which the abrasive wheel is commonly used (e.g., 18,000 RPM for a 7.6 centimeter (3 inch) diameter wheel, which means that the wheel must commonly withstand testing at 50% overspeed or 27,000 R.P.M.).

DISCLOSURE OF THE INVENTION

The present invention provides an improved means for releasably attaching an abrasive wheel to a spindle, which means allows the abrasive wheel to be attached to, and normally released from the spindle without the use of tools, does not include separable attachment parts, does not require a bolt to be supplied with each abrasive wheel, restricts stress concentration points adjacent the inner flange and provides firm support between the flanges when the abrasive wheel is used.

According to the present invention there is provided a combination of an abrasive wheel generally of the type described above in which abrasive material is attached between and projects radially from between spaced inner and outer flanges of a hub. The inner flange of the hub has a central opening and a socket recessed from its outer surface around the opening, and the outer flange of the hub has a central opening and at least one thread around the opening. Also included is a drive spindle which, like known spindles, has a portion adapted to be engaged by a chuck of a drive motor to rotate the spindle about its axis. The spindle has a threaded end portion adapted to be received through the opening in the inner flange and to engage with the thread around the opening of the outer flange from inside the hub, and has a collar adapted to seat in the socket in the inner flange upon sufficient engagement of the threaded end portion with the outer flange to coaxially center the inner flange about the spindle and to limit and cause tight engagement between the threaded end portion and the outer flange. Further rotation of the spindle in the direction to engage the threaded end portion of the spindle with the thread will cause the abrasive wheel to rotate with the spindle, and engagement of the collar and threaded end portion with the flanges will hold the flanges together as the abrasive wheel is used. The thread is disposed so that frictional engagement of the abrasive wheel in its intended direction of rotation will tend to engage the abrasive wheel with the spindle. The abrasive wheel can, however, usually be removed after use by grasping it around its periphery and rotating it in a direction opposite its intended direction of rotation while holding the spindle stationary.

BRIEF DESCRIPTION OF THE DRAWING

The present invention will be more thoroughly described with reference to the accompanying drawing wherein like numbers refer to like parts in the several views, and wherein.

DETAILED DESCRIPTION

Figure 1:
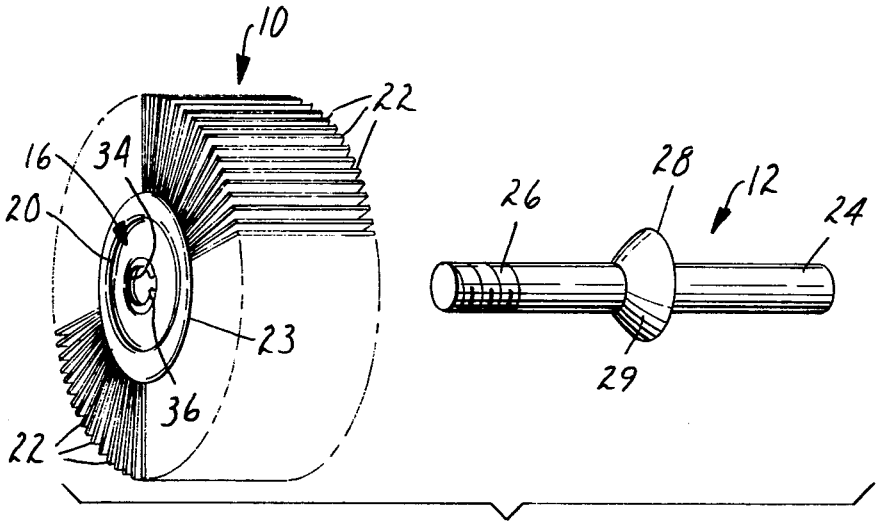
FIG. 1 is an exploded perspective view of an abrasive wheel and spindle combination according to the present invention.
Figure 2:
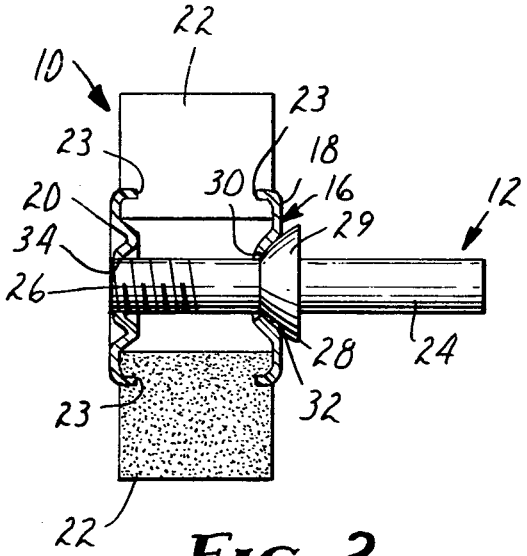
FIG. 2 is a sectional view of the abrasive wheel and spindle combination of FIG. 1, shown with the abrasive wheel engaged on the spindle.

Referring now to the drawing there is shown a combination of an abrasive wheel 10 and a spindle 12 according to the present invention.

The abrasive wheel 10 is generally of the type comprising a hub 16 having an axis, spaced inner and outer flanges 18 and 19, and abrasive material fastened between and projecting radially outwardly from between the flanges 18 and 20. As illustrated, the abrasive material comprises a multiplicity of flexible strips 22 each having an abrasive coating on one surface. Means comprising inwardly turned lips 23 around the flanges 18 and 20 engaging mating grooves in the strips 22 and an adhesive fasten end portions of the strips 22 between the flanges 18 and 20 so that opposite end portions of the strips 22 project generally radially outwardly of the hub 16 with the major surfaces of the strips 22 generally parallel to the axis of the hub 16. Alternatively, however, the abrasive material could be in another form such as a hollow cylindrical abrasive coated random woven member of the material sold under the trademark "Scotch-Brite" by Minnesota Mining and Manufacturing Company of St. Paul, Minn.

The spindle 12 is of the type having an axis and a drive end portion 24 adapted to be releasably engaged in a conventional chuck on a drive motor (not shown) for rotation about its axis.

Novel means are provided for releasably and coaxially attaching the hub 16 and the spindle 12 together to afford transferring rotational torque through the spindle 12 to the abrasive wheel 10. The spindle 12 has a threaded end portion 26 opposite its drive end portion 24, and a collar 28 between its end portions 24 and 26 that has a generally frustro-conical shape with an arcuate convex outer surface 29 so that it increases in diameter from adjacent the threaded end portion 26 toward the drive portion 24 of the spindle 12. The inner flange 18 of the hub 16 has an opening 30 around the axis of the hub 16 adapted to pass the threaded end portion 26 of the spindle 12 and a socket 32 around the opening 30 recessed from the outer surface of the inner flange 18 adapted to conform to and receive a corresponding surface on a portion of the collar 28. The outer flange 20 has an axially-centered opening 34 and at least one thread 36 around the opening 34 adapted to threadably receive the threaded end portion 26 of the spindle 12. As illustrated, the end portion 26 preferably has only a few threads adjacent its distal end which precludes the spindle 12 from being improperly engaged with the wheel from the wrong side of the hub 16.

To attach the flap wheel 10 to the spindle 12 (assuming the drive portion 24 of the spindle 12 is attached in the chuck of a drive motor) a user moves the inner flange 18 of the hub 16 over the threaded end portion 26 of the spindle 12 from its distal end with the threaded end portion 26 in its central opening 30 until the inner surface of its outer flange 20 contacts the distal end of the threaded end portion 26. The inner surface of the outer flange 20 is tapered axially outwardly of the hub 16 around the opening 34 so that pressure by the outer flange 20 against the end of the spindle 12 causes the outer flange 20 to move to a position with the tip of the threaded end portion 26 in its central opening 34. The user then rotates the abrasive wheel 10 so that the thread 36 around the opening 34 engages the threaded end portion 26. The abrasive wheel 10 is rotated with the thread 26 thus engaged until the collar 28 seats in the socket 32. Such seating coaxially centers the inner flange 18 around the spindle 12 and limits engagement of the threaded end portion 26 with the thread 36 so that subsequent rotation of the spindle 12 by the drive motor in a direction opposite that the flap wheel 10 was rotated into engagement with the spindle 12 will cause the flap wheel 10 to be rotated with the spindle 12. During such rotation and use of the abrasive wheel 10, the inner and outer flanges 18 and 20 will be held together by engagement therewith of the collar 28 and threaded end portion 26. After use the abrasive wheel 10 can be removed from the spindle 12 by rotating it in a direction opposite that by which it was engaged with the spindle 12.

The central portion of the outer flange 20 is dished inwardly of the hub 16 so that even with the part of the outer flange 20 that defines its axially outwardly tapered inner surface for guiding the tip of the spindle 12 to its central opening 34, the tip of the spindle 12 engaged with the thread 34 will not project from the outer flange 20 to restrict its potentially damaging contact with surfaces being abraded.

I claim:

1. In combination, an abrasive wheel capable of high revolutions per minute including a hub having an axis, spaced inner and outer flanges, and abrasive material fastened between and projecting generally radially outwardly from between the flanges; and a one-piece spindle having an axis, a drive portion adapted to be releasably engaged in a drive motor for high speed rotation about its axis, a threaded end portion opposite said drive portion, a collar between said portions that increases in diameter from adjacent said threaded end portion toward said drive portion and a part free of threads joining said collar and said threaded end portion; the inner flange of said hub having an axially-centered opening adapted to pass the threaded end portion of said spindle and an axially-centered socket around said opening adapted to receive a portion of said collar, and said outer flange having an axially-centered opening and only one thread formed by said outer flange around said opening adapted to threadably receive the threaded end portion of said spindle so that engagement of said collar with said socket and engagement of said threaded end portion with said thread provide means for releasably and coaxially attaching said hub and spindle together to afford transferring rotational torque at high speeds from said spindle to said abrasive wheel.

2. An abrasive wheel according to claim 1 wherein the surface of said outer flange adjacent said inner flange is tapered away from said inner flange toward said thread to center the threaded end portion of said spindle at the opening in said outer flange upon movement of the hub of said abrasive wheel over said spindle.

3. An abrasive flap wheel capable of high revolutions per minute adapted for releasable engagement with a spindle having an axis and a drive portion adapted to be releasably engaged in a drive motor for high speed rotation about its axis in a first direction, a threaded end portion opposite said drive portion, and a collar between said portions that increases in diameter from adjacent said threaded end portion toward said drive portion, said abrasive wheel comprising a hub having an axis and axially-spaced inner and outer flanges, a multiplicity of flexible strips each having a coating of abrasive material on one major surface, and being uncoated on their other major surface, and means for fastening end portions of said strips between said flanges with opposite end portions of said strips projecting outwardly of said hub with the major surfaces of said strips generally parallel to the axis of said hub and the coatings of abrasive material on corresponding major surfaces of the strips that lead when said wheel is rotated in said first direction, said inner flange of said hub having an opening around its axis adapted to pass the threaded end portion of said spindle, and a socket around said opening adapted to receive a portion of said collar, and said outer flange having a central opening and only one thread formed by said outer flange around said opening adapted to threadably engage and move along the threaded end portion of said spindle toward said collar upon rotation of said abrasive wheel relative to said spindle in a direction opposite said first direction.

4. An abrasive flap wheel according to claim 3 wherein the surface of said outer flange adjacent said inner flange is tapered away from said inner flange toward said thread to center the threaded end portion of said spindle at the opening in said outer flange upon movement of the hub of said flap wheel over said spindle.

* * * * *

UNITED STATES PATENT AND TRADEMARK OFFICE

CERTIFICATE OF CORRECTION

PATENT NO. : 4,455,788

DATED : June 26, 1984

INVENTOR(S) : Conrad T. Freerks

It is certified that error appears in the above—identified patent and that said Letters Patent is hereby corrected as shown below:

First page at [22] "Filed: Oct. 25, 1981" should read --Filed: Oct. 25, 1983--.

Col. 3, line 14, "19" should read --20--.

Signed and Sealed this

*Fourth* Day of *December 1984*

[SEAL]

*Attest:*

GERALD J. MOSSINGHOFF

*Attesting Officer*

*Commissioner of Patents and Trademarks*